US006840411B2

(12) United States Patent
Fritz

(10) Patent No.: US 6,840,411 B2
(45) Date of Patent: Jan. 11, 2005

(54) STORAGE AND DISPLAY DEVICE FOR BASEBALL-TYPE CAPS

(76) Inventor: Wayne Fritz, 14432 Weir Cir., Omaha, NE (US) 68137

( * ) Notice: Subject to any disclaimer, the term of this patent is extended or adjusted under 35 U.S.C. 154(b) by 0 days.

(21) Appl. No.: 10/195,944

(22) Filed: Jul. 16, 2002

(65) Prior Publication Data

US 2003/0029893 A1 Feb. 13, 2003

Related U.S. Application Data

(60) Provisional application No. 60/310,663, filed on Aug. 8, 2001.

(51) Int. Cl.[7] ..... A42C 1/00
(52) U.S. Cl. ..... 223/24
(58) Field of Search ..... 223/24, DIG. 2, 223/25; D6/319

(56) References Cited

U.S. PATENT DOCUMENTS 5,480,073 A * 1/1996 LaManna ..... 223/1
5,685,465 A * 11/1997 Berardis ..... 223/84
5,727,694 A * 3/1998 Larson ..... 211/33
6,311,879 B1 * 11/2001 Rigler et al. ..... 223/84
6,422,400 B1 * 7/2002 Miller ..... 211/32
6,422,401 B1 * 7/2002 Roten ..... 211/32

* cited by examiner

*Primary Examiner*—Rodney M. Lindsey
*Assistant Examiner*—James G Smith
(74) *Attorney, Agent, or Firm*—Adam H. Jacobs

(57) ABSTRACT

A storage and display device for baseball-type caps having a domed cap section and a brim mounted thereon includes a base and at least one generally concave brim shaping and receiving arcuate wall section mounted on and extending outwards from the base, the arcuate wall section having an inner curved wall surface and outer edges. The arcuate wall section is operative to receive a brim of a baseball-type cap therein and force the brim to retain a curved shape along a longitudinal axis thereof when the brim is in at least partial adjacent contact with the inner curved wall surface. A brim retaining wall structure mounted adjacent the outer edges of the arcuate wall section frictionally contacts a section of the brim when the brim is within the arcuate wall section thereby releasably retaining the brim on the storage and display device.

6 Claims, 6 Drawing Sheets

STORAGE AND DISPLAY DEVICE FOR BASEBALL-TYPE CAPS

CROSS-REFERENCE TO RELATED PROVISIONAL APPLICATION

This application claims priority to the filing date of related provisional patent application Ser. No. 60/310,663 filed Aug. 8, 2001.

BACKGROUND OF THE INVENTION

1. Technical Field

The present invention relates to storage devices for caps and, more particularly, to a storage and display device for baseball-type caps which includes a base plate on which is mounted at least one brim-receiving and retaining cylinder extending generally perpendicular thereto, the cylinder operative to receive and retain a brim of a baseball-type cap therein thus releasably securing the baseball-type cap on the storage device while acting to retain the desired curvature of the brim of the cap.

2. Description of the Prior Art

The wearing of baseball-type caps has become increasingly popular over the years as both a way to identify oneself with particular sports clubs or to express an opinion or belief held by the person wearing the cap. Not only do the caps identify particular beliefs or affiliations, they are also comfortable to wear and provide a reasonable amount of head protection from rain, wind, or the like. Unfortunately, it is this popularity of use which often leads to the accidental destruction of the baseball cap.

To many wearers, the most important elements of the baseball cap are the appearance of the cap and that the brim of the cap be curved in a desired manner. When the majority of baseball caps are not being worn, however, they rest on any available surface and are prone to being folded, stepped on or crushed. Although many baseball-type caps are specifically designed to withstand some degree of abuse, at a certain point even the most durable of caps becomes disfigured and thus unwearable. There is therefore a need for an easily used storage system for baseball-type caps which would prevent such destruction.

There are numerous types of baseball-type cap storage devices found in the prior art which attempt to address and solve this problem, including Robak, U.S. Pat. No. 6,196,428, Barbaccia, U.S. Pat. No. 5,991,927, Berardis, U.S. Pat. No. 5,685,465, and Levin, U.S. Pat. No. 5,533,652. Each of these examples of the prior art disclose various ways to retain and display baseball-type caps on a display rack or the like, yet each of them include inherent deficiencies, with the unifying deficiency being the relative complexity of each of the devices as compared with desirable simplicity for a storage device. There is therefore a need for a baseball-type cap storage device which will accept and retain a baseball-type cap thereon while maintaining the desired curvature of the brim on the cap and do so in an easy-to-use manner.

Finally, it should be noted that an important desirable feature is ease of placement and removability from a storage rack. Those devices found in the prior art invariably require a series of steps to retain the cap on the storage device which detracts from the usefulness of the storage device, making it less likely that a user of the device will be satisfied with the storage system and more likely that the cap will be damaged by the storage system itself. There is therefore a need for a simple and efficient cap storage device which does not require a series of steps to accept and retain a baseball-type cap thereon.

Therefore, an object of the present invention is to provide an improved storage and display device for baseball-type caps.

Another object of the present invention is to provide a storage and display device for baseball-type caps which includes a base plate on which is mounted at least one brim-receiving and retaining cylinder, the cylinder operative to receive and retain a brim of a baseball-type cap therein due to the frictional contact between the edges of the brim and the inner wall of the cylinder.

Another object of the present invention is to provide an improved storage and display device for a baseball-type caps which includes connection devices to connect a series of storage and display devices of the present invention to one another for storage of multiple caps.

Another object of the present invention is to provide an improved storage and display device for baseball-type caps in which the brim of the cap may merely be inserted into the brim receiving and retaining cylinder and released to securely mount the cap on the storage and display device of the present invention, thus eliminating the multiple steps of installation and retention required by those devices found in the prior art.

Another object of the present invention is to provide a storage and display device for baseball-type caps which will retain the desired curvature of the brim of the cap during the storage term.

Finally, an object of the present invention is to provide a storage and display device for baseball-type caps which is relatively simple and inexpensive to construct and is safe, efficient, and aesthetically pleasing in use.

SUMMARY OF THE INVENTION

The present invention provides a storage and display device for baseball-type caps having a domed cap section and a brim mounted thereon which includes a base and at least one generally concave brim shaping and receiving arcuate wall section mounted on and extending outwards from the base, the arcuate wall section having an inner curved wall surface and outer edges. The arcuate wall section is operative to receive a brim of a baseball-type cap therein and force the brim to retain a curved shape along a longitudinal axis thereof when the brim is in at least partial adjacent contact with the inner curved wall surface of the at least one generally concave brim shaping and receiving arcuate wall section. For releasably securing the brim of the cap within the arcuate wall section, at least one brim retaining wall structure is mounted on the base adjacent the outer edges of the at least one generally concave brim shaping and receiving arcuate wall section for frictionally contacting a section of a brim of a baseball-type cap when the brim is within the at least one generally concave brim shaping and receiving arcuate wall section. The brim of the baseball-type cap is thereby releasably retained on the storage and display device of the present invention.

It is thus seen that the present invention provides a substantial improvement over those inventions found in the prior art. For example, the design of the present invention permits the user to quickly and easily remove and replace caps on the storage device without requiring the numerous securement steps which are mandated by many of the devices found in the prior art. Furthermore, as the present invention is relatively simple in design and manufacture, a greater number of cap wearers will be able to obtain and use the invention, which is an improvement over the prior art. Finally, because the present invention frictionally retains the brim of the cap on the device while "keeping the curve" of the brim, there is less chance of damage being inflicted on the cap than is presented by other devices found in the art. The present invention thus provides a substantial improvement over the prior art.

DESCRIPTION OF THE PREFERRED EMBODIMENT

Figure 1:
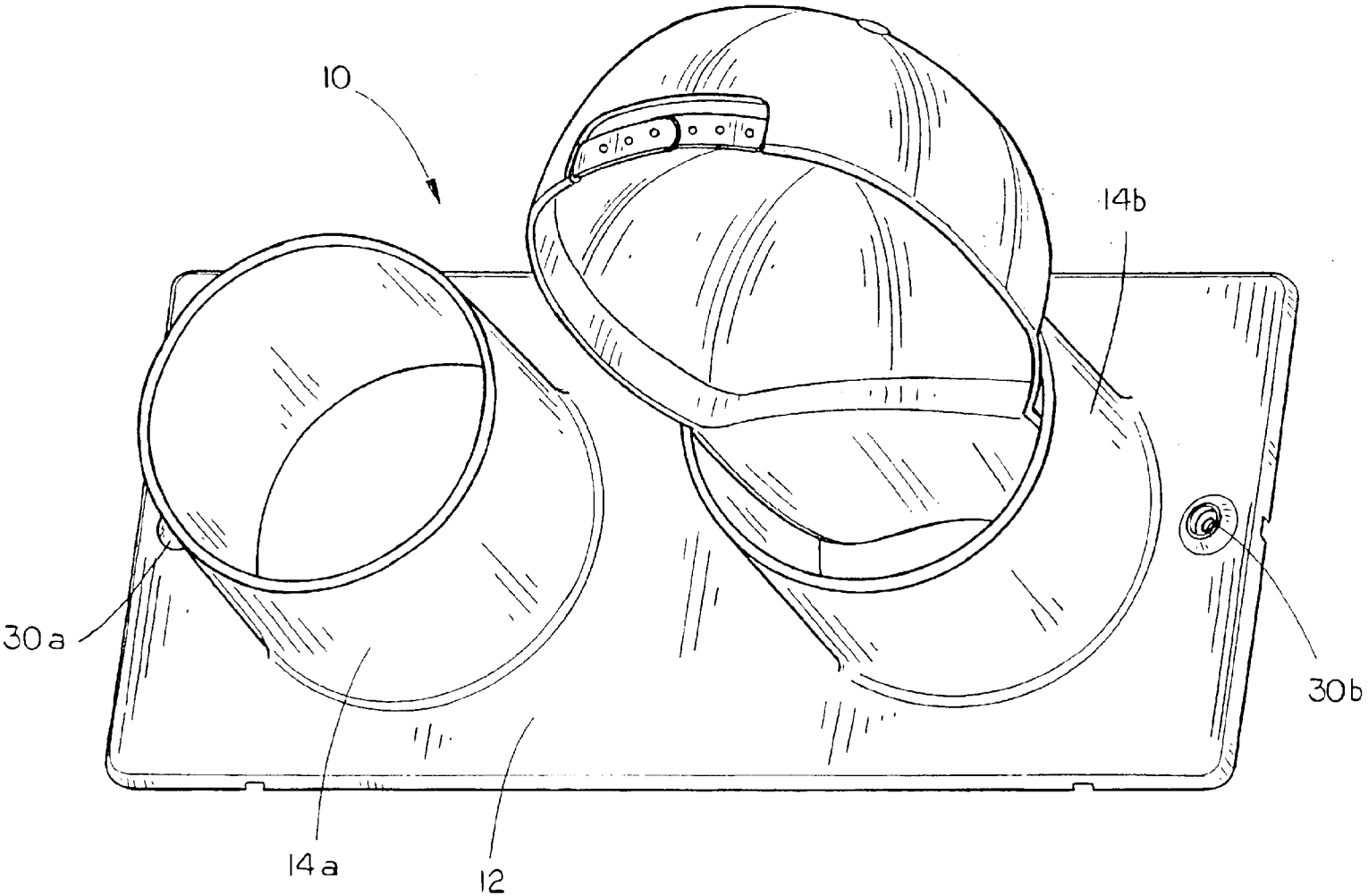
FIG. 1 is a perspective view of the storage and display device of the present invention showing the features thereof.
Figure 2:
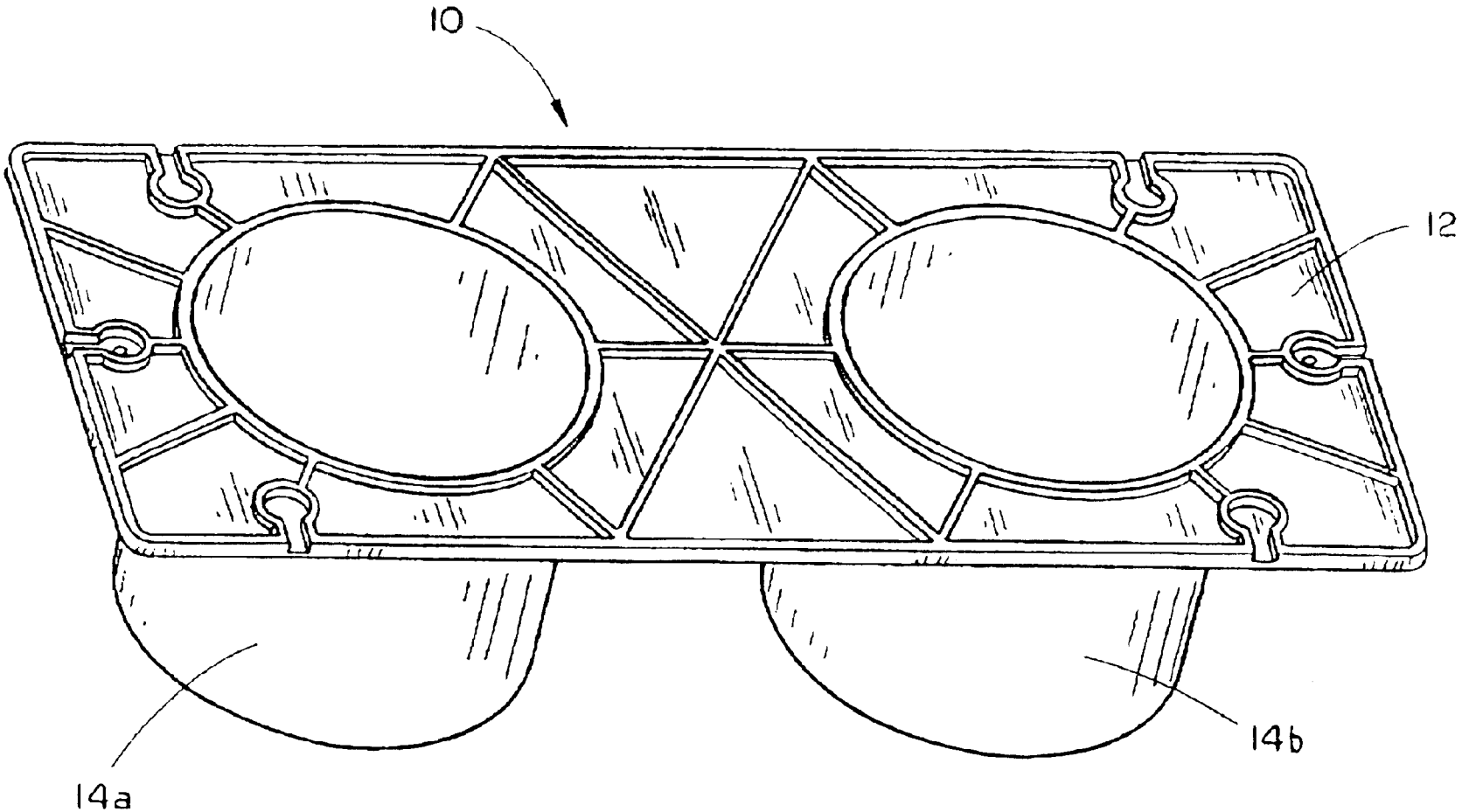
FIG. 2 is a rear perspective view of the present invention.

The cap storage and display device 10 of the present invention is shown best in FIGS. 1 and 2 as including a generally rectangular base plate 12 which in the preferred embodiment would be constructed of a high-impact plastic and would have dimensions of approximately ten to fifteen inches (10" to 15") in length, five to eight inches (5" to 8") in width and one-eighth to one-half and inch (⅛" to ½") in thickness. Mounted on and extending generally perpendicularly from the base plate 12 is at least one brim-receiving and retaining cylinder 14*a* which, in the preferred embodiment, would be constructed of the same material as base plate 12 and would have dimensions of approximately three and one-half to five inches (3½" to 5") in diameter, two to five inches (2" to 5") in height and one-eighth to one-half and inch (⅛" to ½") in thickness. As shown in FIGS. 1 and 2, one embodiment of the present invention would include two cylinders 14*a* and 14*b* mounted side-by-side on base plate 12 and extending generally parallel with one another, though it should be clear that the use of multiple cylinders and base plates of varying sizes and shapes are contemplated by the present invention and are part of this disclosure.

The present invention receives and retains baseball-type caps in the following manner. The user of the present invention would place the brim of his or her hat adjacent the open end of one of the brim-receiving and retaining cylinders 14*a* and 14*b* with the head section of the cap extending outwards from the cap storage and display device 10 generally perpendicular to the base plate 12. Due to the curvature of the brim of the cap, it need only be flexed slightly to increase the curvature to permit the brim to fit into the cylinder 14*a*. Once the brim is pushed into the cylinder 14*a* as far as it will go, releasing the brim permits the natural elasticity of the brim to return the brim to its original, lessened curvature. However, as the cylinder 14*a* surrounds the brim, as the brim flexes outwards it encounters the inner wall of the cylinder 14*a* and this wall prevents the brim from returning entirely to its original curvature. The tension remaining in the brim seats the cap within the cylinder 14*a* through frictional forces, and thus the cap is retained on the cap storage and display device 10 of the present invention. As an added benefit, the retention of the brim in a slightly flexed position results in the brim retaining its intended and preferred curvature, which is highly desirable to wearers of baseball-type caps. The combination of retention of the cap and simultaneous retention of the desired curvature of the brim is a unique benefit supplied by the present invention.

Figure 3:
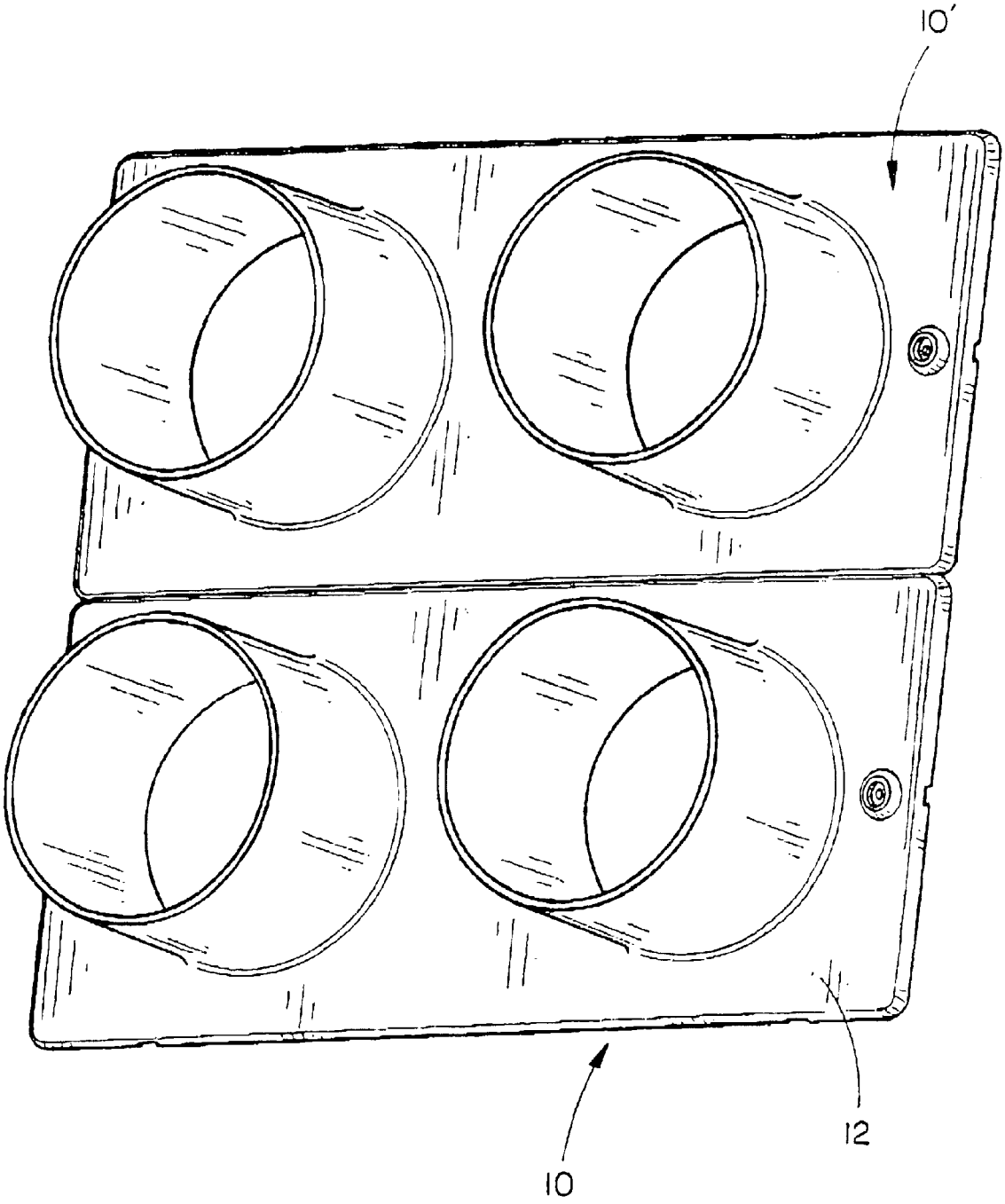
FIG. 3 is a perspective view of two units of the storage and display device of the present invention being interconnected.
Figure 4:
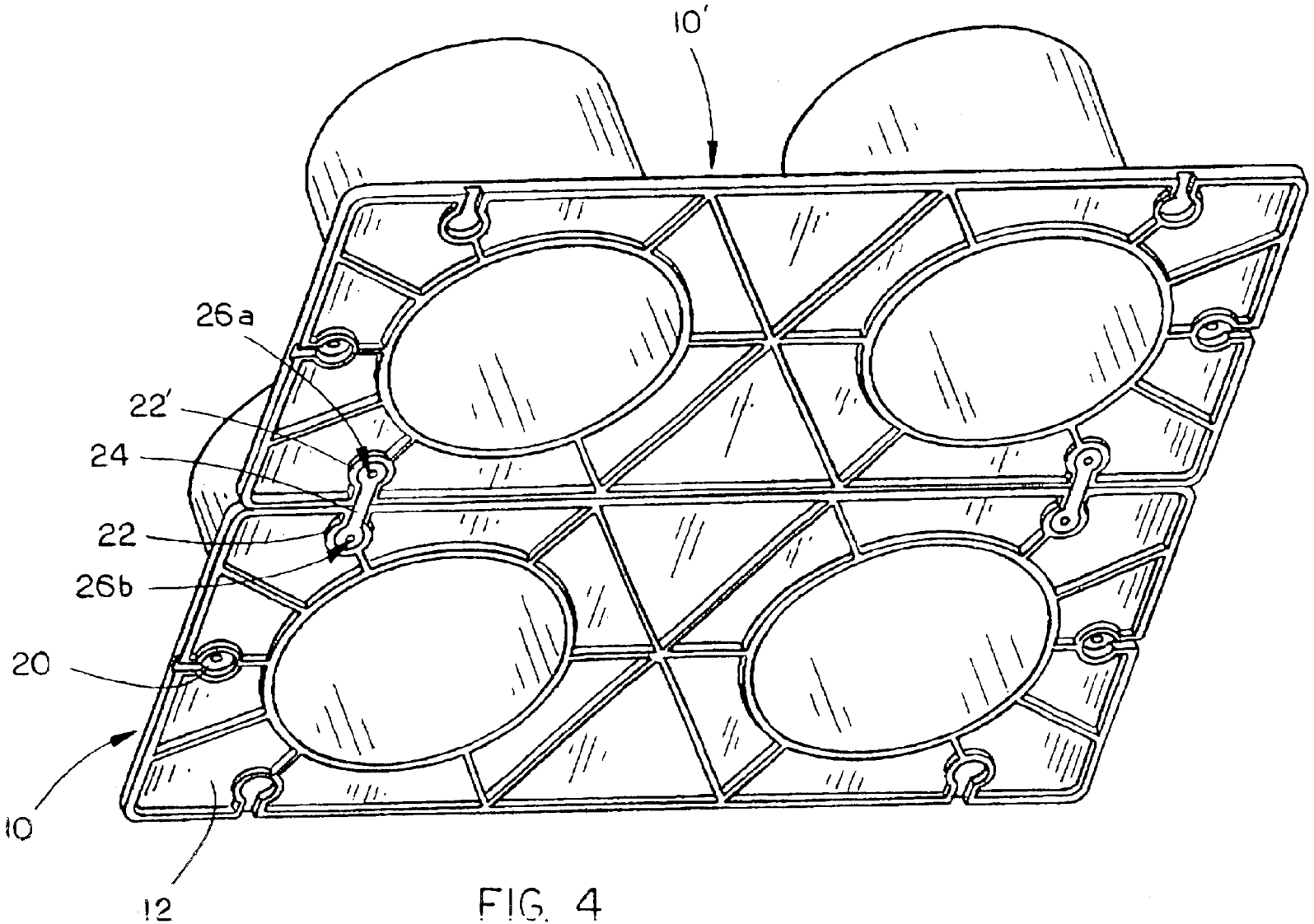
FIG. 4 is a rear perspective view of two units of the present invention being interconnected.
Figure 5:
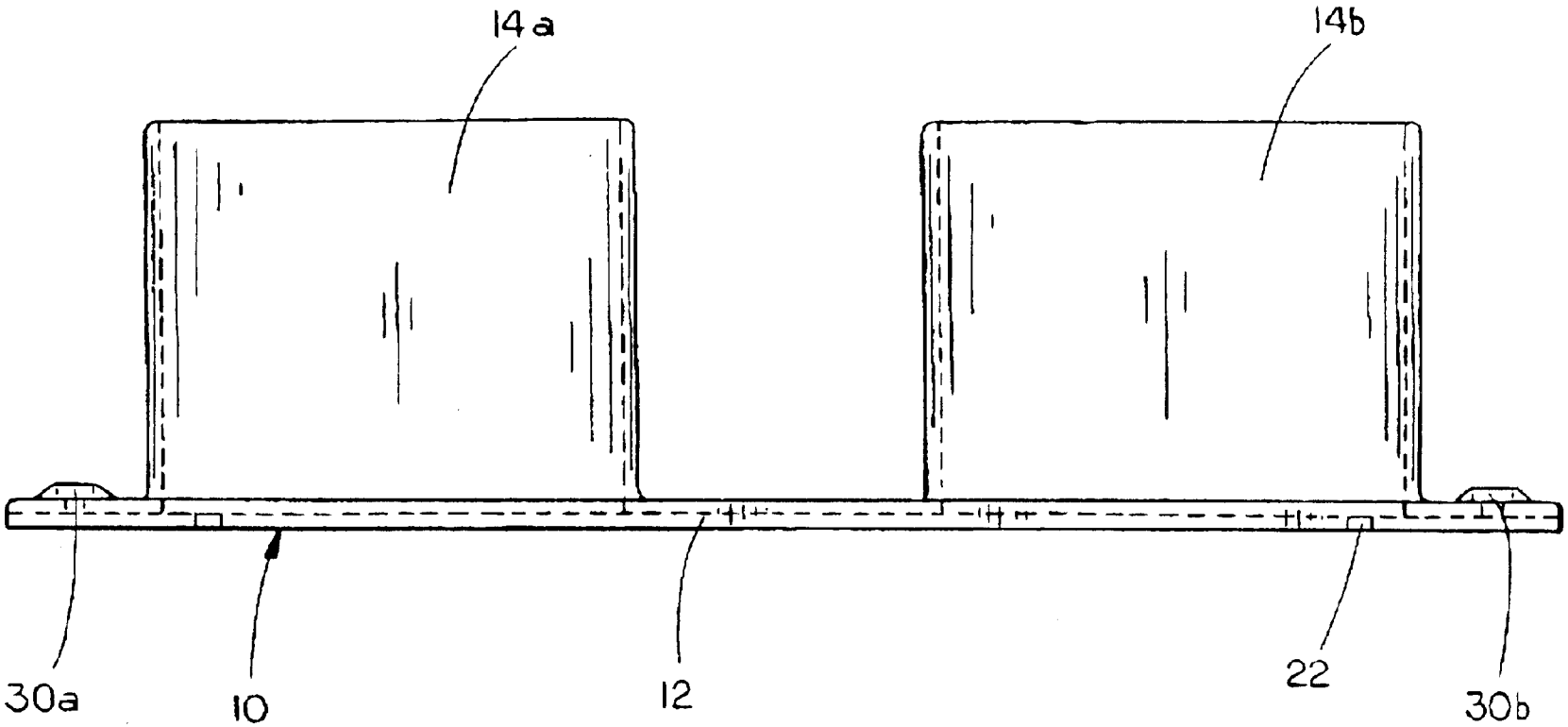
FIG. 5 is a side elevational view of the present invention.

FIGS. 3 and 4 disclose a further advantage of the present invention, as it is shown that single units of the present invention can be connected to one another to form extended cap storage arrangements. For example, the cap storage and display device 10 is placed adjacent to a second cap storage and display device 10' as shown in FIG. 3. The connecting system 20 is shown best in FIG. 4 as including a plurality of generally keyhole-shaped sockets 22 formed on the underside of base plate 12 through various molding techniques known to those skilled in the art of plastics construction. The keyhole-shaped sockets 22 are positioned such that when a second cap storage and display device 10' is placed adjacent to the cap storage and display device 10 of the present invention, at least one keyhole-shaped socket 22 on the first cap storage and display device 10 can be aligned with at least one of the keyhole-shaped sockets 22' on the second cap storage and display device 10', as shown in FIG. 4. Once the keyhole-shaped sockets 22 and 22' are generally aligned, a snap-fit coupler bar 24 is positioned over the keyhole-shaped sockets 22 and 22' and is inserted into the sockets 22 and 22'. The shapes of the ends 26*a* and 26*b* of the coupler bar 24 are such that the ends 26*a* and 26*b* fit within and are releasably secured by the sockets 22 and 22' in a "snap-fit" manner thereby releasably securing the first cap storage and display device 10 to the second cap storage and display device 10'. As shown in FIG. 4, multiple coupler bars may be used to more securely connect the first cap storage and display device 10 to the second cap storage and display device 10'. Of course, various other types of connection devices and systems are usable with the present invention, all of which would be understood by one skilled in the art, and therefore the present invention is not limited to those connection systems described herein.

For mounting the cap storage and display device 10 on a wall or the like, a pair of mounting holes 30*a* and 30*b* are formed in the base plate 12 which extend therethrough. A nail, screw or other such fastening device may be inserted through the mounting holes 30*a* and 30*b* and then inserted into the wall or other support surface such as a desk thus mounting the present invention in the desired location. Various other mounting means may be used which would be understood by those skilled in the art. Also, it is expected that the use of the present invention would not be restricted in any way to mere mounting of the units on a wall surface or the like, but instead would encompass various designs such as spheres, cubes, curved ribbons or virtually any other arrangement of the units of the present invention permitted by the connecting system 20 and the imagination of the builder.

Figure 6:
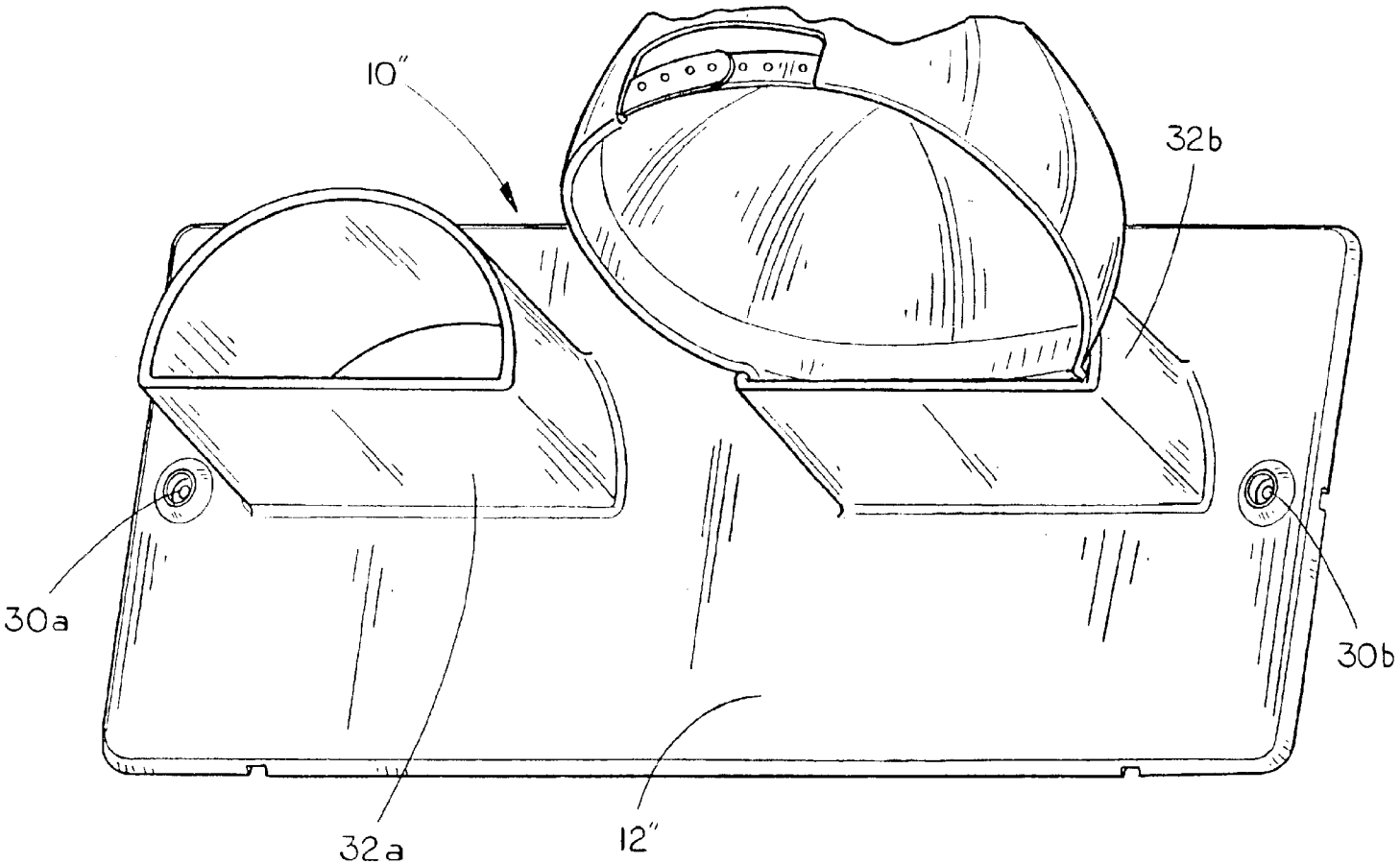
FIG. 6 is a perspective view of an alternative embodiment of the present invention with the lower wall of the cylinder replaced with a straight retention wall.

Finally, FIG. 6 discloses an alternative embodiment of the cap storage and display device 10" of the present invention in which the cylinders 14*a* and 14*b* of FIG. 1 are replaced by semi-cylinders 32*a* and 32*b* such that the brim of the hat is supported within the semi-cylinder 32*a* as mounted on base plate 12" with the edges of the brim resting on the lower generally horizontal wall section of the semi-cylinder 32*a*. Of course, it should be noted that the exact dimensions of the arcuate wall section of semi-cylinder 32*a* and the positioning of the lower generally horizontal wall section relative thereto are to be determined by the hat to be retained in the semi-cylinder 32*a*, although as the majority of baseball-type caps are of similar dimensions, the dimensions of the semi-cylinders 32*a* and 32*b* will be similar in radius to the cylinders 14*a* and 14*b* of FIG. 1.

It is to be understood that numerous modifications, additions and substitutions may be made to the present invention which fall within the intended broad scope of the above disclosure. For example, although the present invention has been described for use in connection with baseball-type caps, other types of hats with brims may be used with the present invention. Also, the precise size, shape and dimensions of the elements of the present invention, including the base plate and the cylinders and semi-cylinders involved, may be modified or changed so long as the intended functionality of the present invention is not modified or destroyed. Specifically, the shape of the present invention can be changed to others beyond merely a square or rectangular base depending on the desires of the purchaser, and the present invention can be mounted horizontally or in another orientation without sacrificing performance of the unit. For example, the unit may be constructed with a hexagonal base or may be positioned on a desk or table surface for supporting the cap thereon. Finally, the precise type of connection device used to connect the separate cap storage and display devices is not critical to the present invention as other types of connection devices are known in the prior art.

There has therefore been shown and described a cap storage and display device which accomplishes at least all of its intended objectives.

What is claimed is:

1. A storage and display device for baseball-type caps having a domed cap section and a brim mounted thereon, said storage and display device for baseball-type caps comprising;

a generally planar base;

at least one generally concave brim shaping and receiving arcuate wall section mounted on and extending outwards from said base, said arcuate wall section having an inner curved wall surface and outer edges and being operative to receive a brim of a baseball-type cap therein and force the brim to retain a curved shape along a longitudinal axis thereof when the brim is in at least partial adjacent contact with said inner curved wall surface of said at least one generally concave brim shaping and receiving arcuate wall section;

at least one brim retaining wall structure mounted on said generally planar base adjacent said outer edges of said at least one generally concave brim shaping and receiving arcuate wall section for frictionally contacting a section of a brim of a baseball-type cap when the brim is within said at least one generally concave brim shaping and receiving arcuate wall section thereby releasably retaining a brim of a baseball-type cap on said storage and display device;

said at least one generally concave brim shaping and receiving arcuate wall section and said at least one brim retaining wall structure cooperating to form at least one brim-receiving and retaining cylinder, said at least one generally concave brim shaping and receiving arcuate wall section and said at least one brim retaining wall structure each having a longitudinal axis extending generally perpendicularly to and outwards from said generally planar base such that the longitudinal axis of said at least one brim-receiving and retaining cylinder is generally perpendicular to said generally planar base.

2. The storage and display device for baseball-type caps of claim 1 wherein said base is a generally rectangular flat plate.

3. The storage and display device for baseball-type caps of claim 1 further comprising a connecting system for releasably securing adjacent storage and display devices to one another thereby forming extended cap storage arrangements.

4. The storage and display device for baseball-type caps of claim 3, wherein said connecting system further comprises a plurality of generally keyhole-shaped sockets formed on the underside of said base, at least one of said plurality of generally keyhole-shaped sockets on said base operative to be generally aligned with at least one of said plurality of generally keyhole-shaped sockets of a base of an adjacent storage and display device for baseball-type caps and a snap-fit coupler bar is positioned over the adjacent keyhole-shaped sockets, inserted into said adjacent keyhole-shaped sockets and are releasably secured by said adjacent keyhole-shaped sockets in a "snap-fit" manner thereby releasably securing adjacent storage and display devices to one another.

5. In combination:

at least one baseball-type cap having a domed cap section and a curved brim having an initial curvature mounted thereon; and a storage and display device for baseball-type caps including;

a generally planar base;

at least one brim-receiving and retaining cylinder mounted on and extending outwards from said generally planar base, said at least one brim-receiving and retaining cylinder having a curved inner wall operative to engage said brim of said at least one baseball-type cap, said brim being flexed slightly thereby increasing the curvature of said brim beyond said initial curvature to permit the brim to fit into the cylinder, having a longitudinal axis said at least one brim-receiving and retaining cylinder extending generally perpendicularly to and outwards from said generally planar base;

said brim returning towards its initial curvature upon being released and encountering said inner wall of said at least one brim-receiving and retaining cylinder, said inner wall preventing said brim from returning entirely to its initial curvature thereby frictionally securing said brim within said at least one brim-receiving and retaining cylinder and thus releasably mounting said at least one baseball-type cap on said storage and display device for baseball-type caps while simultaneously retaining the curvature of the curved brim, which is highly desirable to wearers of baseball-type caps.

6. In combination:

at least one baseball-type cap having a domed cap section and a curved brim having left and right edges and an initial curvature mounted thereon; and a storage and display device for baseball-type caps including;

a generally planar base;

at least one generally concave brim shaping and receiving arcuate wall section mounted on and extending outwards from said generally planar base, said arcuate wall section having an inner curved wall surface and outer edges and being operative to receive said brim of said baseball-type cap therein and force said brim to retain a curved shape along a longitudinal axis thereof when said brim is in at least partial adjacent contact with said inner curved wall surface of said at least one generally concave brim shaping and receiving arcuate wall section;

at least one brim retaining wall structure mounted on said generally planar base adjacent said outer edges of said at least one generally concave brim shaping and receiving arcuate wall section for frictionally contacting only said left and right edges of said brim of said baseball-type cap when said brim is within said at least one generally concave brim shaping and receiving arcuate wall section thereby releasably retaining said brim of said baseball-type cap on said storage and display device; and said at least one generally concave brim shaping and receiving arcuate wall section and said at least one brim retaining wall structure each having a longitudinal axis extending generally perpendicularly to and outwards from said generally planar base such that the longitudinal axis of said at least one brim-receiving and retaining cylinder is generally perpendicular to said generally planar base.

* * * * *